US009039125B2

(12) United States Patent
Shrader

(10) Patent No.: US 9,039,125 B2
(45) Date of Patent: May 26, 2015

(54) MULTIPLE LAYER STRUCTURES FOR VOID CONTROL IN INK JET PRINTERS

(71) Applicant: Palo Alto Research Center Incorporated, Palo Alto, CA (US)

(72) Inventor: Eric J. Shrader, Belmont, CA (US)

(73) Assignee: PALO ALTO RESEARCH CENTER INCORPORATED, Palo Alto, CA (US)

( * ) Notice: Subject to any disclaimer, the term of this patent is extended or adjusted under 35 U.S.C. 154(b) by 98 days.

(21) Appl. No.: 13/714,365

(22) Filed: Dec. 13, 2012

(65) Prior Publication Data

US 2014/0168310 A1 Jun. 19, 2014

(51) Int. Cl.

| | |
|---|---|
| ***B41J 29/38*** | (2006.01) |
| ***B41J 2/04*** | (2006.01) |
| ***B41J 2/14*** | (2006.01) |
| ***B41J 2/055*** | (2006.01) |
| ***B41J 2/175*** | (2006.01) |
| ***B41J 2/19*** | (2006.01) |

(52) U.S. Cl.

CPC ..... *B41J 2/1408* (2013.01); *B41J 2/055* (2013.01); *B41J 2/14201* (2013.01); *B41J 2002/14419* (2013.01); *B41J 2/17593* (2013.01); *B41J 2/19* (2013.01)

(58) Field of Classification Search

CPC .. B41J 2/17513; B41J 2/1408; B41J 2/14201; B41J 2/17593

USPC ..... 347/17, 54, 65

See application file for complete search history.

(56) References Cited

U.S. PATENT DOCUMENTS

| | | | | |
|---|---|---|---|---|
| 4,100,904 | A | 7/1978 | Eckert et al. | |
| 4,517,541 | A | 5/1985 | Ubukata et al. | |
| 4,586,653 | A | 5/1986 | Foller et al. | |
| 5,509,390 | A | 4/1996 | Tuckey | |
| 5,518,025 | A | 5/1996 | Futa, Jr. et al. | |
| 5,604,338 | A | 2/1997 | Paxton et al. | |
| 6,588,890 | B1 | 7/2003 | Furlani et al. | |
| 6,764,166 | B2 | 7/2004 | Silverbrook | |
| 6,830,316 | B2 | 12/2004 | Silverbrook | |
| 2014/0022307 | A1 * | 1/2014 | Gao et al. | 347/54 |

* cited by examiner

*Primary Examiner* — Jannelle M Lebron

(74) *Attorney, Agent, or Firm* — Hollingsworth Davis, LLC

(57) ABSTRACT

Approaches to remove bubbles from ink in an ink jet printer are described. Bubble removal may be implemented using a membrane disposed along an ink flow path. The membrane includes first and second component membranes having first and second coefficients of thermal expansion. The membrane is configured to, in response to a change in ink temperature, mechanically displace as a function of temperature due to a difference in the thermal coefficients of expansion of the first and second component membranes. The mechanical displacement of the membrane causes a volumetric change in a portion of the ink flow path.

18 Claims, 10 Drawing Sheets

MULTIPLE LAYER STRUCTURES FOR VOID CONTROL IN INK JET PRINTERS

TECHNICAL FIELD

This application relates generally to techniques useful for inkjet printing. The application also relates to components, devices, systems, and methods pertaining to such techniques.

SUMMARY

Embodiments discussed in the disclosure are directed to methods and devices used in ink jet printing.

Some embodiments involve a subassembly for an inkjet printer. The subassembly includes a membrane disposed along an ink flow path. The membrane comprises first and second component membranes having first and second coefficients of thermal expansion. The membrane is configured to, in response to a change in ink temperature, mechanically displace as a function of temperature due to a difference in the thermal coefficients of expansion of the first and second component membranes. The mechanical displacement of the membrane causes a volumetric change in a portion of the ink flow path.

According to various aspects, the membrane is a bimetallic membrane. In some implementations, the membrane is configured to provide an abrupt mechanical displacement which causes an abrupt pressurization of ink in the portion of the ink flow path in response to the ink temperature reaching an activation temperature. The activation temperature of the membrane may correspond to a mushy zone temperature of ink. In some cases, the activation temperature is about 80° C.

The membrane may be configured to provide a gradual mechanical displacement which causes a gradual pressurization of ink in the portion of the ink flow path as a function of temperature. In some embodiments, the membrane is configured to provide a substantially linear mechanical displacement which causes a substantially linear pressurization of ink in the portion of the ink flow path as a function of temperature.

According to various implementations, the subassembly also includes one or more heaters configured to heat the ink and to impart a thermal gradient in the ink along the ink flow path. A first and a second membrane have an activation temperature $T_{act}$ and the thermal gradient causes the first membrane to mechanically displace before the second membrane mechanically displaces during a time that the ink is undergoing a phase change.

In some cases, the membrane is disposed in a printhead of the subassembly. According to various aspects, the membrane is disposed in a reservoir of the subassembly. In some implementations, the dual thermal coefficient membrane is disposed in a manifold of the subassembly.

Some embodiments involve a method of heating or cooling ink in an ink flow path to cause a phase change of the ink. The phase change of the ink causes a volumetric change in a portion of the ink flow path during the phase change. The volumetric change is caused by mechanical displacement of a membrane as a function of temperature. The membrane includes first and second component membranes having first and second thermal coefficients of expansion. The mechanical displacement is caused by differences in the first and second thermal coefficients of expansion.

In some cases, causing the volumetric change comprises pressurizing the ink in the ink flow path. According to various aspects, causing the volumetric change comprises causing an abrupt mechanical displacement that occurs at an activation temperature. In some implementations, causing the volumetric change comprises causing a gradual mechanical displacement that occurs over a temperature range.

According to various embodiments, causing the volumetric change comprises pressurizing the ink during a time that the ink is undergoing a phase change and ink in a first portion of the ink flow path is in a solid phase, ink in a second portion of the ink flow path is in a liquid phase, and ink in the portion of the ink flow path is at a mushy zone temperature range. In some cases, the first portion comprises inkjet nozzles and the second portion comprises an ink reservoir. Pressurizing the ink may include forcing voids from ink in the portion of the ink flow path into the second portion.

In some implementations, a system includes one or more structures fluidically coupled to define an ink flow path. The ink flow path is configured to contain a phase change ink. The system includes means for causing a volumetric change in a portion of the ink flow path during a phase change of the ink. In some cases, the means for causing the volumetric change is configured to cause the volumetric change when the ink in the portion reaches a mushy zone temperature.

The above summary is not intended to describe each embodiment or every implementation. A more complete understanding will become apparent and appreciated by referring to the following detailed description and claims in conjunction with the accompanying drawings.

DESCRIPTION OF VARIOUS EMBODIMENTS

Figure 1:
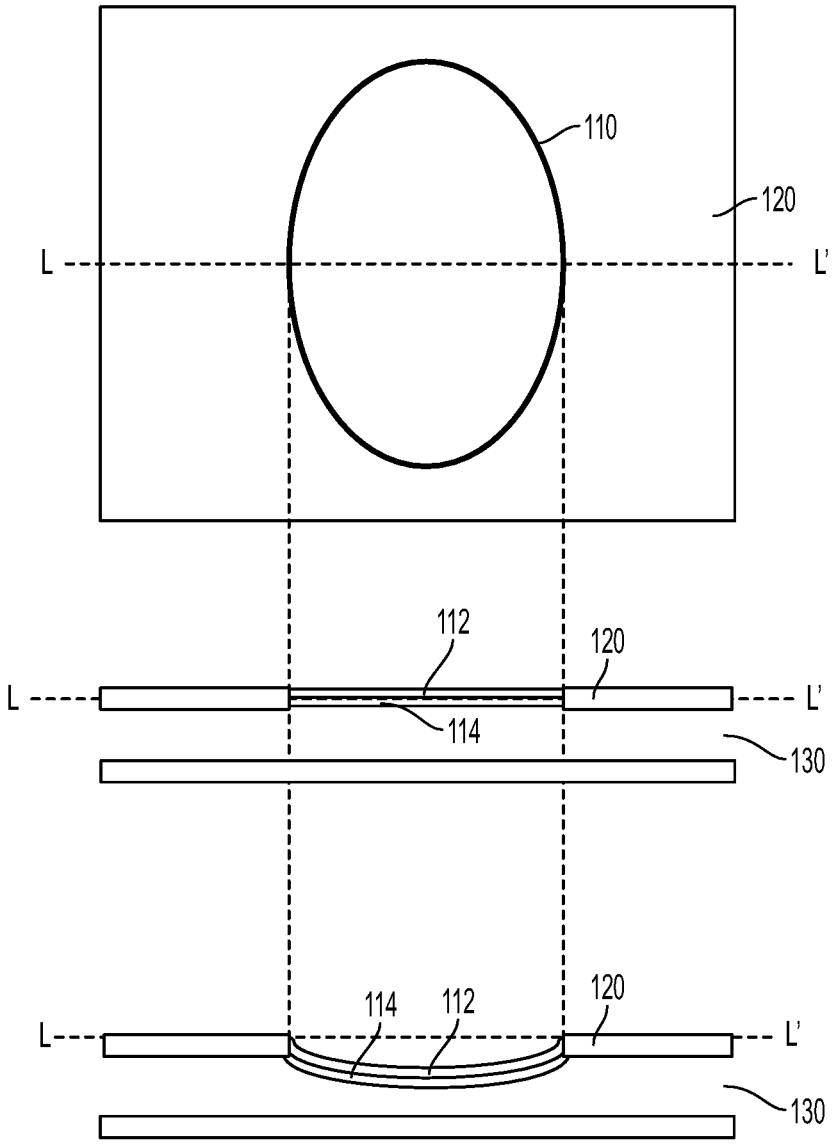
FIG. 1 shows an example of a bimetallic membrane disposed on a surface of an ink flow path.

Ink jet printers operate by ejecting small droplets of liquid ink onto print media according to a predetermined pattern. In some implementations, the ink is ejected directly on a final print media, such as paper. In some implementations, the ink is ejected on an intermediate print media, e.g. a print drum, and is then transferred from the intermediate print media to the final print media. Some ink jet printers use cartridges of liquid ink to supply the ink jets. Some printers use phase-change ink which is solid at room temperature and is melted before being jetted onto the print media surface. Phase-change inks that are solid at room temperature advantageously allow the ink to be transported and loaded into the ink jet printer in solid form, without the packaging or cartridges typically used for liquid inks In some implementations, the solid ink is melted in a page-width print head which jets the molten ink in a page-width pattern onto an intermediate drum. The pattern on the intermediate drum is transferred onto paper through a pressure nip.

In the liquid state, ink may contain bubbles that can obstruct the passages of the ink jet pathways. For example, bubbles can form in solid ink printers due to the freeze-melt cycles of the ink that occur as the ink freezes when printer is powered down and melts when the printer is powered up for use. As the ink freezes to a solid, it contracts, forming voids in the ink that can be subsequently filled by air. When the solid ink melts prior to ink jetting, the air in the voids can become bubbles in the liquid ink.

When phase change ink, which contains a mixture of components, is freezing along an ink flow path, there is typically a mushy zone that spans some temperature range between fully molten and fully solid ink in which only some of the mixture components are frozen.

One mechanism that has been shown to help eliminate the voids that turn into bubbles is pressurization of the fluid passages during the freezing and the melting of the ink. This has been demonstrated to be effective at reducing bubbles by pressurizing the reservoir after the nozzles have frozen. The pressurization forces more ink into the volume as it shrinks A dual thermal membrane can be introduced into an ink flow path. Dual thermal membranes have at least two component membranes with different coefficients of thermal expansion (COEs). The different component membranes expand at different rates at a given temperature. While materials other than metals can be used, the examples provided herein are directed to bimetallic membranes. The bimetallic membranes comprise first and second component metallic membranes, wherein the metal of the first component membrane has a different coefficient of thermal expansion than the second component membrane.

In some cases, bimetallic membranes are configured to gradually deflect over a temperature range. According to various embodiments, bimetallic membranes can operate substantially linearly over a temperature range to change the pressure of a passage or chamber. The gradual mechanical deflection of the membrane produces a gradual pressure on the ink which pushes air bubbles out of the system. In some embodiments, the membrane may abruptly deflect. Abrupt mechanical displacement can cause an abrupt pressurization of the ink which may facilitate removal of pockets of air from the ink flow path in some situations.

The operating range of the bimetallic membranes can be tailored to the temperature range where bubbles are formed. According to various embodiments described herein, the bimetallic membrane is configured to deflect at a temperature within the mushy zone temperature where the ink is mushy as it transition from liquid and solid or from solid to liquid. For example, the mushy zone temperature range for some inks is about 75° to 85° C. For example, in various scenarios, as the ink freezes, the bimetallic membranes gradually or abruptly deflect into the ink flow path. As the ink melts from the frozen state, the bimetallic gradually or abruptly return to their undeflected state. It will be appreciated, that in various embodiments, the deflection of the bimetallic membranes may be reversed, i.e., the membranes may be undeflected while the ink is frozen and may deflect as the ink melts.

FIG. 1 shows an example of a bimetallic membrane 110 disposed along ink flow path 130. The upper portion of FIG. 1 is a top view of the bimetallic membrane 110 disposed along an portion of a structure or layer 120 that forms the ink flow path 130. The bimetallic membrane includes a first component membrane 112, having thermal coefficient of expansion, $\alpha_1$, and a second component membrane 114, having thermal coefficient of expansion, $\alpha_2$, where $\alpha_1 \neq \alpha_2$. The bimetallic membrane 110 is in an undeflected state in the cross section through L-L' shown in the middle portion of FIG. 10. As the temperature of the ink changes, the first component membrane 112 expands more than the second component membrane 114 due to their different thermal coefficients of expansion. The cross section through L-L' shown at the lower portion of FIG. 1 shows the bimetallic membrane 110 deflecting into the ink flow path 130. The deflection causes a volumetric change in the ink flow path where the bimetallic membrane is positioned.

Figure 2:
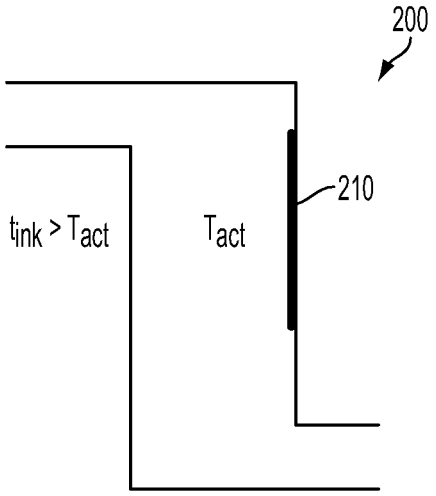
FIGS. 2 and 3 illustrate the use of a bimetallic membrane that is incorporated into a surface within an ink flow path.
Figure 3:
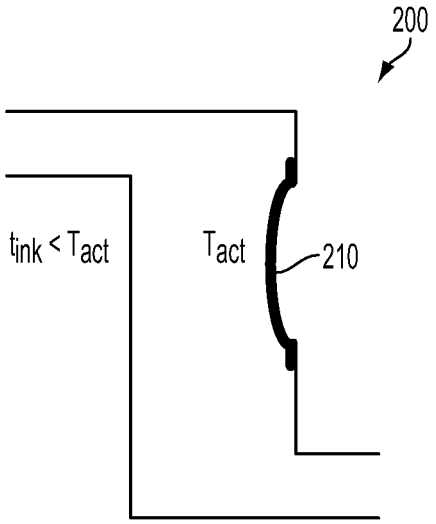

The bimetallic membrane can be configured to deflect at a particular ink temperature, such as when the ink in the vicinity of the bimetallic membrane is at a mushy zone temperature of the ink which occurs as the ink is freezing. FIGS. 2 and 3 illustrate the use of a bimetallic membrane disposed along an ink flow path. FIG. 2 shows an example of an ink flow path 200 and bimetallic membrane 210 in an undeflected state. In the example shown in FIG. 2, the temperature of the ink, $t_{ink}$, within the ink flow path is greater than the activation temperature, $T_{act}$, of the bimetallic membrane 210 and thus the bimetallic membrane 210 remains undeflected. FIG. 3 shows the ink flow path 200 at a time that $t_{ink}$ has dropped below the $T_{act}$ of the bimetallic membrane 210 causing the bimetallic membrane 210 to deflect into the ink flow path. The deflection of the bimetallic membrane 210 into the ink flow path 200 causes a volumetric decrease of the ink flow path at the portion of the ink flow path where the bimetallic membrane is located. The $T_{act}$ of the bimetallic membrane 210 may be selected so that the bimetallic membrane applies pressure on the ink in the ink flow path 1100 as the ink is in the mushy temperature zone of the ink phase change, e.g., as the ink changes phase from liquid to solid or solid to liquid.

Figure 4:
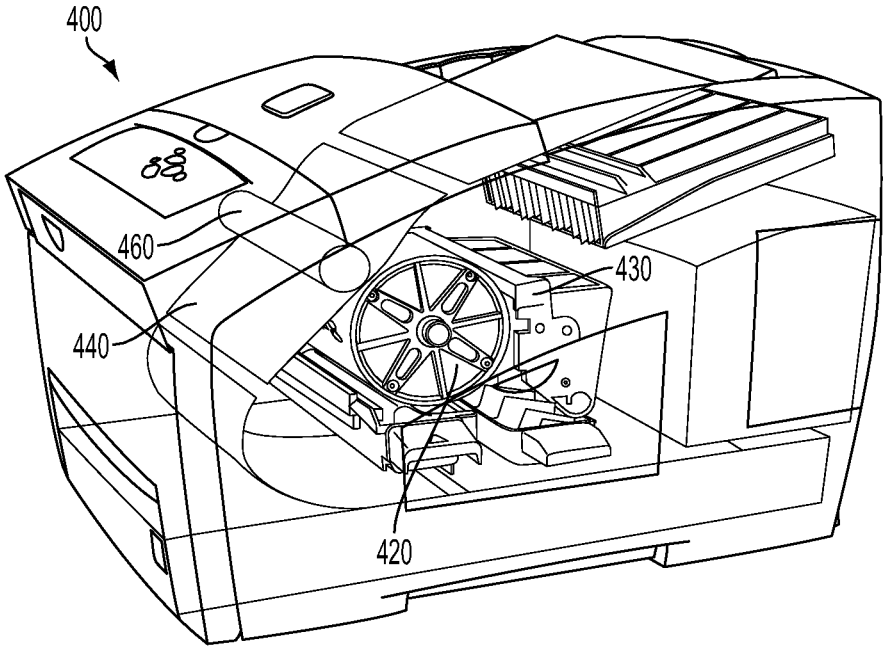
FIGS. 4 and 5 provide internal views of portions of an ink jet printer that incorporates void and bubble reduction approaches, such as bimetallic membranes.
Figure 5:
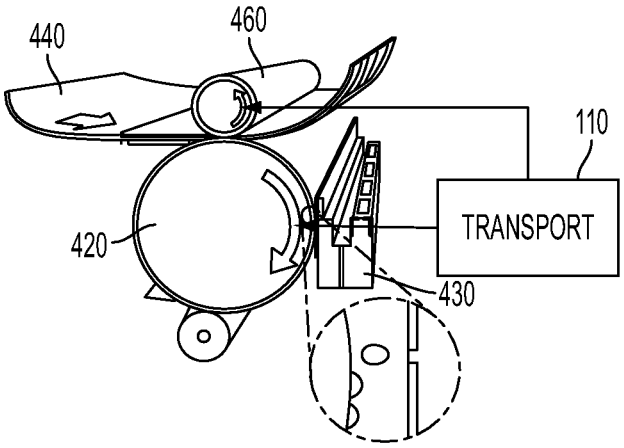

FIGS. 4 and 5 provide internal views of portions of an ink jet printer 100 that incorporates void and bubble reduction approaches, such as multiple membrane elements, as discussed herein. The printer 400 includes a transport mechanism 110 that is configured to move the drum 420 relative to the print head assembly 430 and to move the paper 140 relative to the drum 420. The print head assembly 430 may extend fully or partially along the length of the drum 420 and may include, for example, one or more ink reservoirs 431, e.g., a reservoir for each color, and a print head 432 that includes a number of ink jets. As the drum 420 is rotated by the transport mechanism 110, ink jets of the print head 432 deposit droplets of ink though ink jet apertures onto the drum 420 in the desired pattern. As the paper 440 travels around the drum 420, the pattern of ink on the drum 420 is transferred to the paper 140 through a pressure nip 460.

Figure 6:
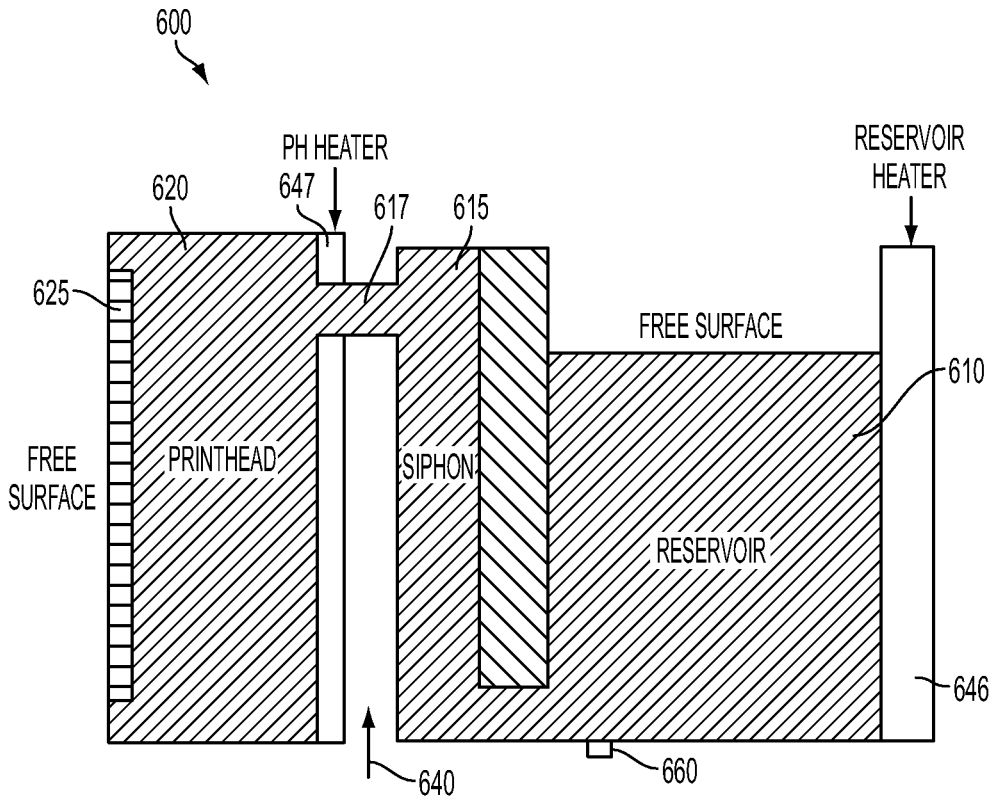
FIG. 6 is a cross sectional view of an exemplary print head assembly.

FIG. 6 is a cross sectional view of an exemplary print head assembly 600 that illustrates some of the void and bubble reduction approaches discussed herein. The print head assembly 600 includes an ink reservoir 610 configured to contain a phase-change ink. The reservoir is fluidically coupled to a print head 620 that includes a jet stack. The jet stack may include manifolds and ink jets as previously discussed. In the print head assembly 600 illustrated in FIG. 6, the ink flow path is the fluidic path of the ink that is defined by various components of the print head assembly 600, such as the reservoir 610, siphon 615, print head inlet passage 617 and print head 620. The print head includes a jet stack 625 and the ink flow path within the print head 620 includes the jet stack 625, e.g., main manifolds, finger manifolds. The ink flow path traverses the reservoir 610, through the siphon 615, through the print head inlet passage 617, through print head 620, through the jet stack 625, to the free surface 630 of the print head. The print head assembly 600 illustrated in FIG. 6 has two free surfaces 630, 631. One free surface 631 is at the input side of the ink flow path, at the reservoir 610. Another free surface 630 is at the output side of the ink flow path at the vents and/or jet orifices of the jet stack 625. One or more fluidic structures that form the ink flow path in the print head assembly 600 may be separated from one another by an air gap 640 or other insulator to achieve some amount of thermal decoupling between the fluidic structures.

The print head assembly 600 includes one or more thermal elements 646, 647 that are configured to heat and/or cool the ink along the ink flow path. As depicted in FIG. 5, a first thermal element 646 may be positioned on or near the reservoir 610 and a second thermal element 647 may be positioned on or near the print head 620. In some implementations, the thermal elements 646, 647 may be activated, deactivated, and/or otherwise controlled by a control unit (not shown in FIG. 6). The control unit may comprise, for example, a microprocessor-based circuit unit and/or a programmable logic array circuit or other circuit elements. The control unit may be integrated into the printer control unit or may be a stand-alone unit. In some implementations, the control unit may comprise a control unit configured to control temperature and pressure applied to the ink flow path during a bubble mitigation operation of the print head assembly. Bubble mitigation may occur at start up, shut down, or at any other time during operation of the printer.

The control unit may activate and/or deactivate the thermal elements 646, 647 and/or may otherwise modify the energy output of the thermal elements 646, 647 to achieve the desired set point temperature. The thermal elements can be configured to heat the ink by resistive or inductive heating, for example.

Optionally, the print head assembly 600 may include one or more sensors 660 positioned along the ink flow path or elsewhere on the print head assembly 600. The sensors 660 are capable of sensing the pressure of the ink and/or the temperature of the ink (or components that form the ink flow path) and generating electrical signals modulated by the sensed parameters. In some cases, the control unit uses the sensor signals to generate feedback signals to control the operation of the thermal units 646, 647 and/or other processes.

Optionally, the print head assembly includes a pressure unit (not shown in FIG. 6) configured to apply pressure to the ink at one or more positions along the ink flow path. The pressure unit may include at least one pressure source, one or more input ports coupled to access the ink flow path, and one or more valves that can be used to control the pressure applied to the ink flow path. The pressure source may comprise compressed air or compressed ink, for example. The pressure unit may be controllable by the control unit. In some implementations, the pressure unit may be controlled using feedback signals that are based on the temperature sensor signals and/or sensed pressure signals.

Some approaches to void reduction and subsequent bubble reduction involve creation of a thermal gradient along the ink flow path during a time that the ink is changing phase. The ink may be changing phase from a liquid phase to a solid phase, or to a solid phase to a liquid phase. When ink transitions from liquid to solid phase, the ink contracts, leaving voids in the solid phase ink. These voids may eventually be filled with air, which form air bubbles in the ink when the ink transitions from solid to liquid phase. As the ink is changing phase in the presence of the thermal gradient, a first portion of the ink in a first region of ink flow path may be in liquid phase while a second portion of the ink in a second region of the ink flow path is in solid phase.

A thermal gradient along the ink flow path when the ink is changing phase from liquid to solid may be created to reduce the number of voids that form while the ink is freezing. Keeping a first portion of the ink solid in a first region, e.g., near the print head, and another portion of the ink liquid in a second region, e.g., near the reservoir, allows liquid ink from the reservoir region to flow into the portion of the ink near the freeze front to reduce the number of voids that are formed during the phase transition.

Figure 7:
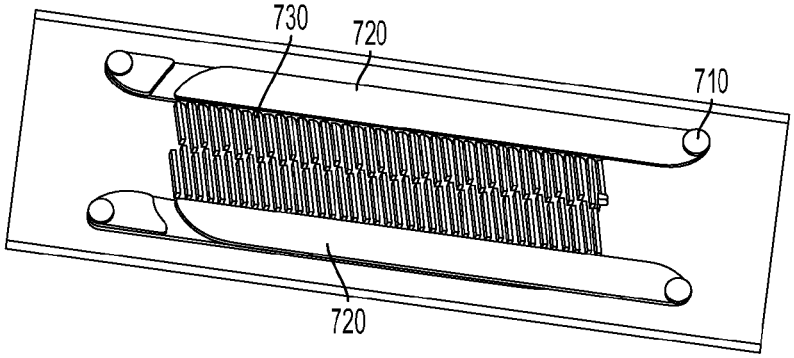
FIGS. 7 and 8 show more detailed views of an exemplary print head assembly.
Figure 8:
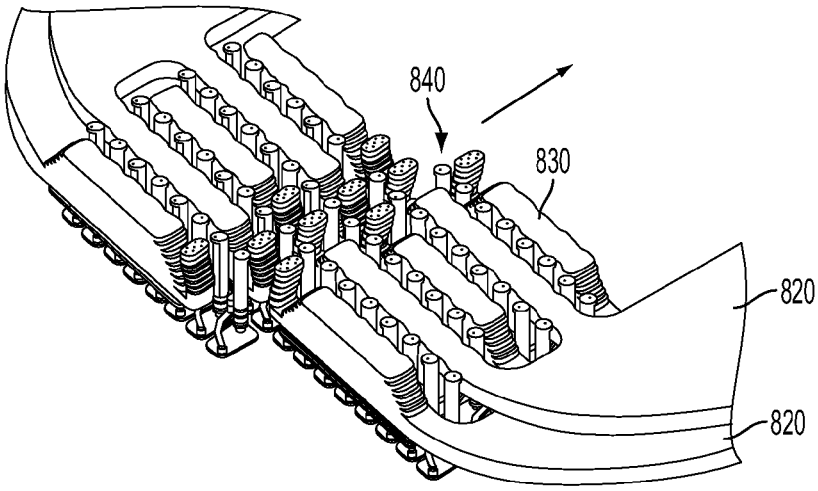

FIGS. 7 and 8 show more detailed views of an exemplary print head assembly. The path of molten ink, contained initially in the reservoir flows through a port 710 into a main manifold 720 of the print head. In some cases, there are four main manifolds 720 which are overlaid, one manifold 720 per ink color, and each of these manifolds 720 connects to interwoven finger manifolds 730. The ink passes through the finger manifolds 730 and then into the ink jets 740. The manifold and ink jet geometry is repeated in the direction of the arrow to achieve a desired print head length, e.g. the full width of the drum. In some cases, the print head uses piezoelectric transducers (PZTs) for ink droplet ejection, although other methods of ink droplet ejection are known and such printers may also use the void and bubble reduction approaches described herein.

Figure 9:
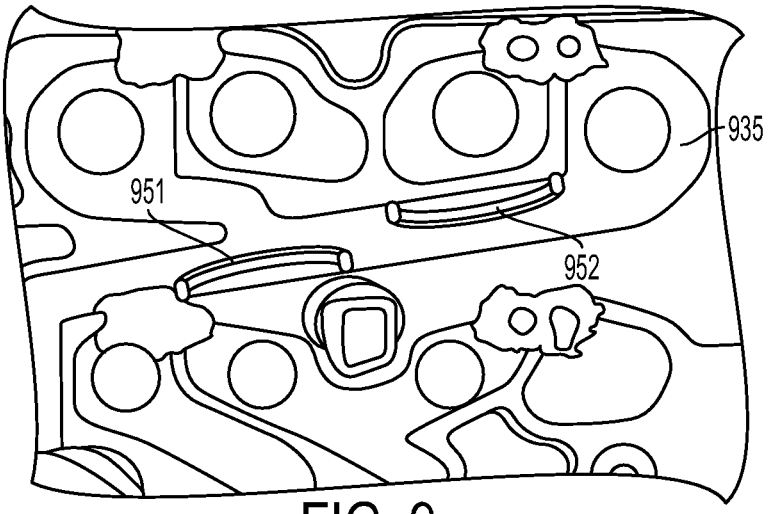
FIGS. 9 and 10 illustrate views of a print head assembly with exemplary locations for bimetallic membranes.
Figure 10:
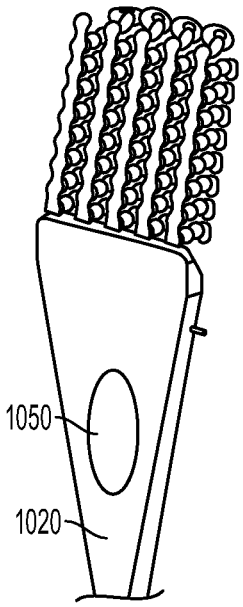

FIGS. 9 and 10 illustrate views of a print head assembly with exemplary locations for bimetallic membranes. FIG. 9 shows an ink flow path 935 with two bimetallic membranes 951, 952. As can be observed from FIG. 9, both bimetallic membranes 951, 952 are deflected into the ink flow path 935. Therefore, in this example, the temperature in the ink flow path is at or below the activation temperature for both of the bimetallic membranes 951, 952. The volume of the ink flow path is reduced in comparison to the volume that would be available if the bimetallic membranes 951, 952 were undeflected. FIG. 10 illustrates a manifold 1020 that includes a bimetallic membrane 1050. According to various embodiments described herein, one or more bimetallic membranes may be disposed in a print head, a reservoir, and or a manifold of an ink jet printer.

Figure 11:
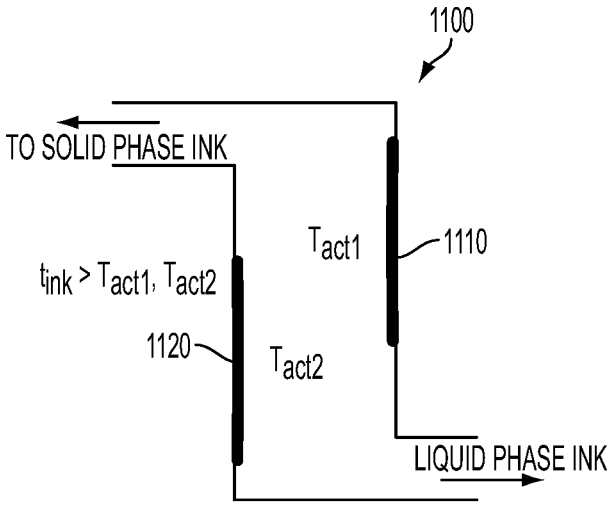
FIGS. 11-13 show examples in which there are two bimetallic membranes in an ink flow path.
Figure 12:
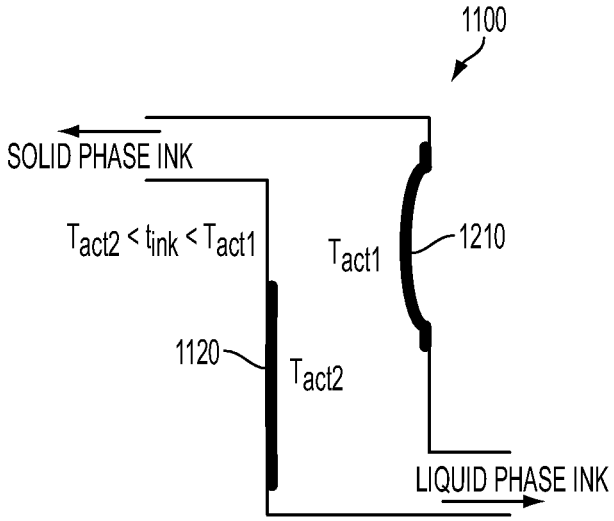
Figure 13:
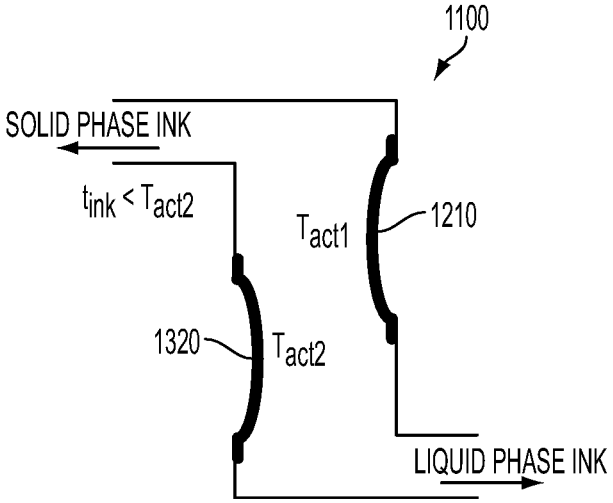

As described with regard to FIG. 9, more than one bimetallic membrane may be used in an ink flow path. FIGS. 11-13 show an example in which there are two bimetallic membranes in an ink flow path. According to FIGS. 11-13, the activation temperature of a first bimetallic membrane has a first activation temperature ($T_{act1}$) and a second bimetallic membrane has a second activation temperature ($T_{act2}$). $T_{act1}$ may be the same temperature or a different temperature than $T_{act2}$. In the examples shown in FIGS. 11-13, $T_{act2}$ is less than $T_{act1}$.

FIG. 11 illustrates an ink flow path 1100 with a first bimetallic membrane 1110 and a second bimetallic membrane 1120. FIG. 11 illustrates a scenario wherein the temperature of the ink ($t_{ink}$) in the ink flow path 1100 is greater than $T_{act1}$ and $T_{act2}$. FIG. 12 shows an example in which $t_{ink}$ has dropped to a level that is below $T_{act1}$, causing the first bimetallic membrane 1210 to deflect into the ink flow path 1100. Because $T_{ink}$ is still above $T_{act2}$, the second bimetallic membrane 1120 is not deflected into the ink flow path. In the scenario of FIG. 13, $t_{ink}$ has dropped below both $T_{act1}$ and $T_{act2}$, causing both the first bimetallic membrane 1210 and the second bimetallic membrane 1320 to deflect into the ink flow path 1100.

Figure 14:
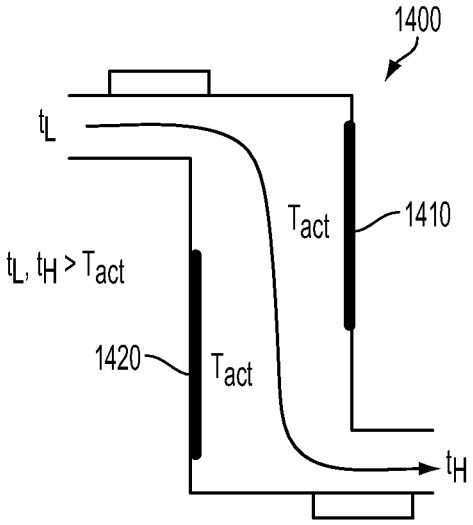
FIGS. 14-16 illustrate ink flow paths containing a thermal gradient.
Figure 15:
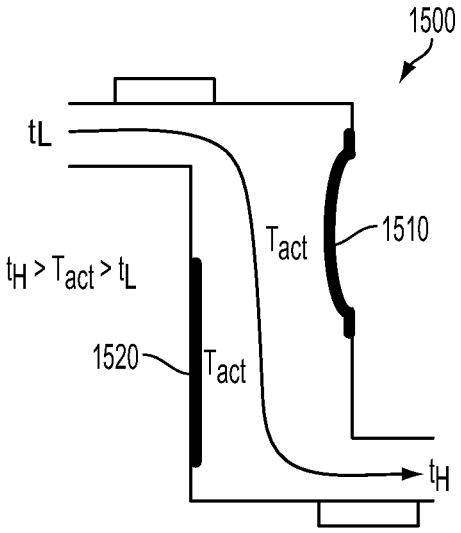
Figure 16:
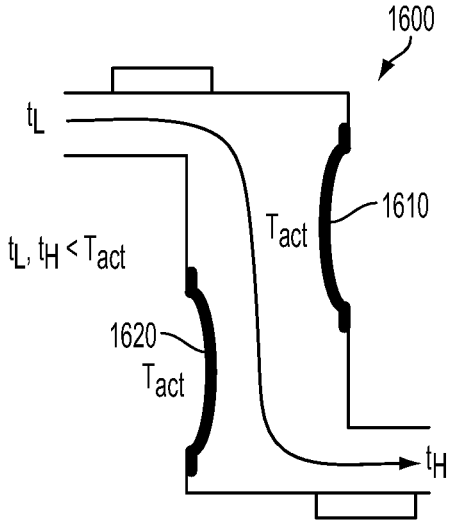

Particularly when the ink is changing phase, the ink in an ink flow path may be at different temperatures at different positions in the ink flow path. A thermal gradient can be created and/or controlled using controllable thermal elements. In some cases, the thermal gradient is controlled to achieve a higher ink temperature at or near a reservoir and a lower ink temperature at or near the print head, for example. FIGS. 14-16 illustrate ink flow paths 1400, 1500, 1600 that contain ink having a thermal gradient from $t_L \rightarrow t_H$ as illustrated in FIG. 14. Each of FIGS. 14-16 illustrate an ink flow path 1400, 1500, 1600 having two bimetallic membranes 1410, 1420, 1510, 1520, 1610, 1620, respectively. A temperature of ink at a first location ($t_L$) is lower than a temperature of ink at a second location ($t_H$). In FIG. 14, both $t_L$ and $t_H$ are greater than the activation temperature of both of the bimetallic membranes ($T_{act}$) 1410, 1420. Because none of the locations in the ink flow path 1400 have dropped below $T_{act}$, neither of the bimetallic membranes 1410, 1420 are deflected into the ink flow path 1400.

FIG. 15 shows an example in which $t_L$ is below $T_{act}$, causing the first bimetallic membrane 1510 to deflect into the ink flow path 1500. The second bimetallic membrane 1520 remains undeflected because $t_H$ is still above $T_{act}$. FIG. 16 illustrates an example in which both $t_L$ and $t_H$ are below $T_{act}$, causing the first bimetallic membrane 1610 and the second bimetallic membrane 1620 to deflect into the ink flow path 1600. As the ink changes phase from liquid to solid, the bimetallic membranes may be configured to deflect in a cascade that corresponds to the change in the ink temperature along the ink flow path.

Figure 17:
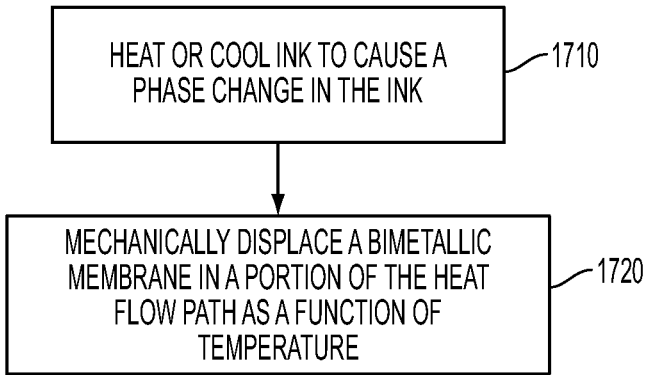
FIG. 17 provides a method of using a bimetallic membrane in an ink flow path.
Figure 18:
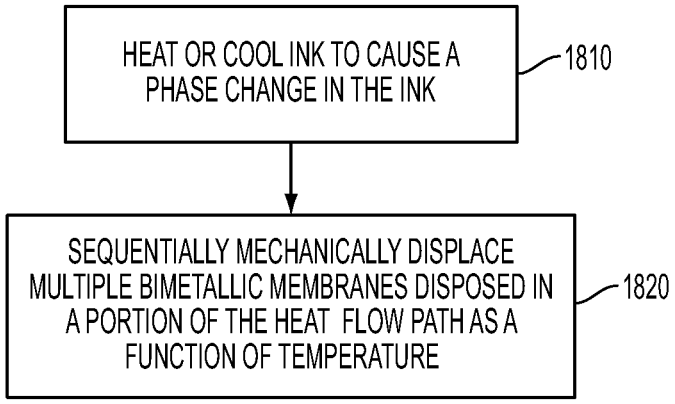
FIG. 18 shows a process of using multiple bimetallic membranes in an ink flow path.

FIGS. 17 and 18 illustrate methods of using bimetallic membranes in an ink flow path. According to FIG. 17, ink is heated or cooled 1710 to cause a phase change in the ink. A bimetallic membrane is mechanically displaced 1720 in a portion of the heat flow path as a function of temperature. The mechanical displacement of the bimetallic membrane involves a deflection into the ink flow path which causes a change in the volume of at least a portion of the ink flow path. The timing of the mechanical displacement of the bimetallic membrane may correspond to the mushy zone temperature of the ink. The mechanical displacement reduces the voids along the ink flow path. As the ink transitions from solid phase to liquid phase, the bimetallic membrane returns to its original undeflected state increasing the volume of the portion of the ink flow path.

FIG. 18 illustrates an example that includes more than one bimetallic membrane disposed along an ink flow path. The ink within the ink flow path is heated or cooled 1810, causing a phase change in the ink. Multiple bimetallic membranes disposed in a portion of the heat flow path are sequentially mechanically displaced 1820 as a function of temperature. The sequential displacement of the bimetallic membranes, e.g. while the ink is near the mushy temperatures zone as the ink is changing phase from liquid to solid, causes voids to be squeegeed out of the ink flow path towards a free surface of the ink flow path, where the air can be released from the system.

Various modifications and additions can be made to the preferred embodiments discussed above. Systems, devices or methods disclosed herein may include one or more of the features, structures, methods, or combinations thereof described herein. For example, a device or method may be implemented to include one or more of the features and/or processes described below. It is intended that such device or method need not include all of the features and/or processes described herein, but may be implemented to include selected features and/or processes that provide useful structures and/or functionality.

What is claimed is:

1. A subassembly for an inkjet printer for phase change ink comprising, a membrane disposed along an ink flow path, the membrane comprising first and second component membranes having first and second coefficients of thermal expansion, the membrane configured to, in response to temperature of the ink reaching an activation temperature, mechanically displace due to a difference in the thermal coefficients of expansion of the first and second component membranes, the activation temperature occurring during a time that the ink undergoes a phase change and transitions from liquid to solid or from solid to liquid, the mechanical displacement of the membrane causing a volumetric change in a portion of the ink flow path.

2. The subassembly of claim 1, wherein the membrane is a bimetallic membrane.

3. The subassembly of claim 1, wherein the membrane is configured to provide an abrupt mechanical displacement which causes an abrupt pressurization of ink in the portion of the ink flow path in response to the ink temperature reaching the activation temperature.

4. The subassembly of claim 1, wherein the activation temperature of the membrane corresponds to a mushy zone temperature of ink.

5. The subassembly of claim 1, wherein the activation temperature is about 80° C.

6. The subassembly of claim 1, wherein the membrane is configured to provide a gradual mechanical displacement which causes a gradual pressurization of ink in the portion of the ink flow path as a function of temperature.

7. The subassembly of claim 1, wherein the membrane is configured to provide a substantially linear mechanical displacement which causes a substantially linear pressurization of ink in the portion of the ink flow path as a function of temperature.

8. The subassembly of claim 1, further comprises one or more heaters configured to heat the ink and to impart a thermal gradient in the ink along the ink flow path, wherein a first and a second membrane have an activation temperature $T_{act}$ and the thermal gradient causes the first membrane to mechanically displace before the second membrane mechanically displaces during a time that the ink is undergoing a phase change.

9. The subassembly of claim 1, wherein the membrane is disposed in a printhead of the subassembly.

10. The subassembly of claim 1, wherein the membrane is disposed in a reservoir of the subassembly.

11. The subassembly of claim 1, wherein the dual thermal coefficient membrane is disposed in a manifold of the subassembly.

12. A method, comprising:

heating or cooling ink in an ink flow path to cause a phase change of the ink; and causing a volumetric change in a portion of the ink flow path during the phase change, the volumetric change caused by mechanical displacement of a membrane as a function of temperature of the ink, the membrane comprising first and second component membranes having first and second thermal coefficients of expansion and the mechanical displacement is caused by differences in the first and second thermal coefficients of expansion, the mechanical displacement of the membrane responsive to the temperature of the ink reaching an activation temperature that occurs during a time that the ink is changing phase from solid to liquid or from liquid to solid.

13. The method of claim 12, wherein causing the volumetric change comprises pressurizing the ink in the ink flow path.

14. The method of claim 12, wherein causing the volumetric change comprises causing an abrupt mechanical displacement that occurs at an activation temperature.

15. The method of claim 12, wherein causing the volumetric change comprises causing a gradual mechanical displacement that occurs over a temperature range.

16. The method of claim 12, wherein causing the volumetric change comprises pressurizing the ink during a time that the ink is undergoing a phase change and ink in a first portion of the ink flow path is in a solid phase, ink in a second portion of the ink flow path is in a liquid phase, and ink in the portion of the ink flow path is at a mushy zone temperature range.

17. The method of claim 16, wherein the first portion comprises inkjet nozzles and the second portion comprises an ink reservoir.

18. The method of claim 16, wherein pressurizing the ink comprises forcing voids from ink in the portion of the ink flow path into the second portion.

* * * * *

UNITED STATES PATENT AND TRADEMARK OFFICE

CERTIFICATE OF CORRECTION

PATENT NO. : 9,039,125 B2
APPLICATION NO. : 13/714365
DATED : May 26, 2015
INVENTOR(S) : Eric J. Shrader It is certified that error appears in the above-identified patent and that said Letters Patent is hereby corrected as shown below:

In the Claims

Column 9, lines 4-9, Claim 16: "The method of claim 12, wherein causing the volumetric change comprises pressurizing the ink during a time that the ink is undergoing a phase change and ink in a first portion of the ink flow path is in a solid phase, ink in a second portion of the ink flow path is in a liquid phase, and ink in the portion of the ink flow path is at a mushy zone temperature range." should read -- The method of claim 12, wherein causing the volumetric change comprises pressurizing the ink during the time that the ink is undergoing the phase change and ink in a first portion of the ink flow path is in a solid phase, ink in a second portion of the ink flow path is in a liquid phase, and ink in the portion of the ink flow path is at a mushy zone temperature range. --.

Signed and Sealed this
Sixth Day of October, 2015

Michelle K. Lee

Michelle K. Lee
*Director of the United States Patent and Trademark Office*